United States Patent [19]

Manhart

[11] Patent Number: 4,491,273

[45] Date of Patent: Jan. 1, 1985

[54] SNOW GUN

[76] Inventor: Michael Manhart, Hinterwies, 6764 Lech a/Arlberg, Austria

[21] Appl. No.: 427,421

[22] Filed: Sep. 29, 1982

[30] Foreign Application Priority Data

Jan. 18, 1982 [EP] European Pat. Off. ..... 8220056.8

[51] Int. Cl.[3] ..... F25C 3/04

[52] U.S. Cl. ..... 239/14; 239/433

[58] Field of Search ..... 239/14, 429, 430, 431, 239/432, 433

[56] References Cited

U.S. PATENT DOCUMENTS

| | | | |
|---|---|---|---|
| 2,613,737 | 10/1952 | Schwietert | 239/431 X |
| 2,676,471 | 4/1954 | Pierce, Jr. | 239/2 S |
| 3,650,476 | 3/1972 | Rackley et al. | 239/432 X |
| 3,831,844 | 8/1974 | Tropeano et al. | 239/14 |
| 4,343,434 | 8/1982 | Haruch | 239/432 X |
| 4,383,646 | 5/1983 | Smith | 239/430 X |

*Primary Examiner*—Andres Kashnikow
*Assistant Examiner*—Mary F. McCarthy
*Attorney, Agent, or Firm*—Zarley, McKee, Thomte, Voorhees & Sease

[57] ABSTRACT

The compressed-air supply line of the snow gun passes through the center of the pressurized-water supply line. The air line opens out into an interior space within the spray head, this space being bounded at the front end by a perforated end piece and serving as a pre-expansion chamber. For the purpose of saving energy, the end piece has at least three centrosymmetrically disposed discharge openings.

4 Claims, 1 Drawing Figure

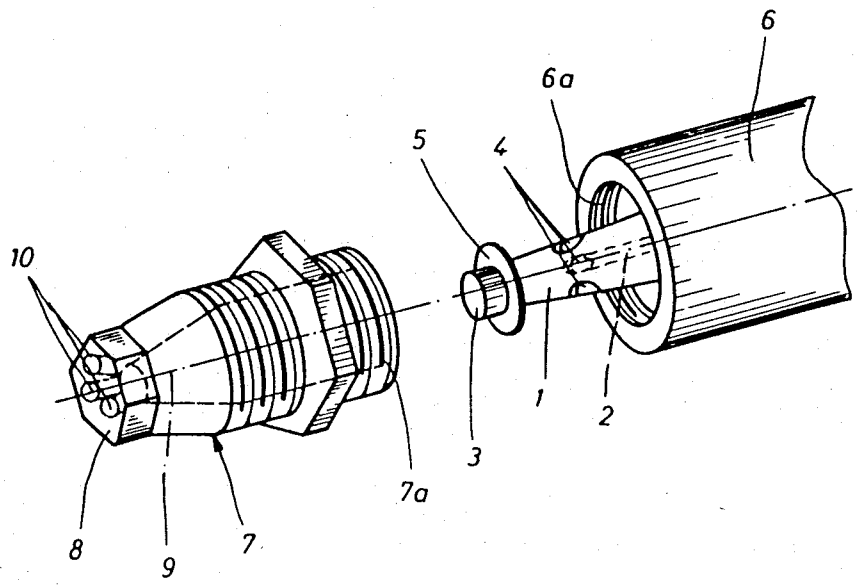
6
6a
4
5
2
1
3
7a
7
9
8
10

SNOW GUN

This invention relates to apparatus for making and distributing snow, and more particularly to a snow gun of the type having a central compressed-air supply line and a pressurized-water supply line disposed coaxially with and surrounding the compressed-air supply line, the latter opening out into an interior space, bounded at the front in the direction of the compressed-air feed by a perforated end piece and serving as a pre-expansion chamber, of a spray head.

The mode of operation of such a snow gun is essentially that a very low temperature develops in the pre-expansion chamber, whereupon condensation nuclei are formed in the air-water mixture as ice particles about which the water already partially freezes into snow. These condensation nuclei are finally ejected or sprayed, together with still unfrozen water particles and compressed air not included in the snow-production process, through a single, central front bore in the end disk, snow being formed in front of this central bore with the aid of the condensation nuclei and the additionally developing cold due to expansion of the compressed air, with the inclusion of the cool ambient air.

Such prior art snow guns have two decisive drawbacks for which the arrangement of a single central perforation of the end disk is responsible. Thus, one effect of this design is that the core of the concentrated stream of air does not participate at all in the conversion to snow for lack of sufficient atomization (or sufficient mixture with the water). The result, aside from the unused kinetic energy of the air stream, i.e., the unnecessary waste of the cold potential inherent therein, is a noise intensity so excessive that possibilities of utilizing such equipment are severely limited. A further result of the lacking or insufficient mixture of air and water is that the emerging jet is surrounded by a sheath of droplets which simply precipitates onto the ground in front of the bore of the end disk as water. Here again, energy is expended for accelerating the water without ultimately being convertible into snow production.

This waste of energy is all the more intolerable in connection with snow guns as considerable energy must in any case be applied in order to activate the cold potential of the ambient air as much as possible by means of a large throwing range.

It is therefore an object of this invention to provide an improved snow gun which achieves a substantially more favorable exploitation of energy by means of increased inclusion of the outside air in the mixing and condensation process, and this with a much lower noise level as compared with prior art snow guns.

To this end, in the snow gun according to the present invention, of the type initially mentioned, the end piece has at least three centrosymmetrically disposed discharge nozzles.

A preferred embodiment of the invention will now be described in detail with reference to the accompanying drawing, which is a partial perspective view showing the spray head unscrewed and moved slightly away from the pressurized-water supply line for the sake of clarity.

A compressed-air duct 2, connected to a source of compressed air (not shown) by any suitable means, passes through inside a compressed-air supply line 1. Duct 2 is closed at its front end by a plug 3. On the other hand, three lateral inner nozzle apertures 4 are provided which communicate with duct 2, and the geometric or central axes of which intersect the geometric or central axis of duct 2 at an acute angle. Adjacent to plug 3 is a collar 5 which stands out perpendicular to the geometric or central axis of duct 2.

Disposed coaxially with compressed-air supply line 1 is the jacket 6 of a pressurized-water supply line, an internal thread 6a of which receives an external thread 7a of a spray head 7. When spray head 7 is screwed on, its inside wall together with an end piece 8 bound a pre-expansion chamber 9 communicating with the outside atmosphere via three centrosymmetrically disposed perforations 10 forming discharge nozzles, none of which is situated on the geometric or central axis of compressed-air supply line 1. Instead of the three perforations 10, any desired plurality of apertures might basically be provided, none of which must be situated on the geometric axis of supply line 1, however.

With the arrangement of three discharge nozzles having the same diameter and three identical inner nozzles, the diameter of a discharge nozzle equals from one to three times the diameter of an inner nozzle. If there are more than three discharge nozzles and three inner nozzles, the area of the cross-section of an outer discharge nozzle, multiplied by the number of outer discharge nozzles and divided by one to nine, is equal to the total area of the cross-sections of the inner nozzles.

The mode of operation of the snow gun according to the foregoing embodiment of the invention differs from that of the prior art snow guns, as described earlier, in that by means of the arrangement of a plurality of perforations 10 offset with respect to the geometric axis of the compressed-air supply line, a considerably better mixture of water and air is made possible inasmuch as the outside air, which it is sought to utilize for the snow production, is swept along between two discharge jets and mixes with these jets comparatively close to the nozzle.

What is claimed is:

1. A snow gun comprising, a central compressed-air supply line, a pressurized-water supply line disposed coaxially with and surrounding said compressed-air supply line, a spray head attached at one end to said pressurized-water supply line and including an interior space serving as a pre-expansion chamber, inner nozzles in said compressed-air supply line having central axes intersecting the central axis of said compressed air supply line and forming an acute angle therewith, said inner nozzles communicating with said pre-expansion chamber, and a perforated end piece attached to the other end of said spray head, bounding said interior space, and including at least three centrosymmetrically disposed discharge nozzles.

2. The snow gun of claim 1, comprising three said discharge nozzles of the same diameter, and further comprising three identical inner nozzles.

3. The snow gun of claim 2, wherein the diameter of said discharge nozzles equals from one to three times the total diameter of said inner nozzles.

4. The snow gun of claim 1 comprising more than three said discharge nozzles and further comprising more than three inner nozzles forming part of said compressed-air supply line and interconnecting the two said supply lines, wherein the area of the cross-section of any one of said discharge nozzles multiplied by the number of said discharge nozzles and divided by one to nine equals the total area of the cross-sections of said inner nozzles.

* * * * *